United States Patent [19]

Noz

[11] 3,986,945

[45] Oct. 19, 1976

[54] DEVICE FOR THE CONTINUOUS APPLICATION OF STRIP-, RIBBON- OR SPOT-SHAPED COATINGS

[75] Inventor: Francis Xaverius Noz, Liechtenstein

[73] Assignee: Galentan AG, Switzerland

[22] Filed: Jan. 21, 1975

[21] Appl. No.: 542,780

[30] Foreign Application Priority Data

Jan. 21, 1974 Switzerland ..... 812/74

[52] U.S. Cl. ..... 204/206; 204/28; 204/DIG. 7

[51] Int. Cl.[2] ..... C25D 17/00

[58] Field of Search ..... 204/DIG. 7, 28, 206–211

[56] References Cited

UNITED STATES PATENTS 3,539,490 11/1970 Gannoe ..... 204/207

3,819,502 6/1974 Meuldijk et al. ..... 204/206

3,855,108 12/1974 Bolz et al. ..... 204/206

*Primary Examiner*—F.C. Edmundson

*Attorney, Agent, or Firm*—Pravel & Wilson

[57] ABSTRACT

A device is disclosed for the continuous application of strip-, ribbon- or spot-shaped coatings of metal layer patterns, particularly of a noble metal such as gold, to an electrically conductive tape comprising a rotatable wheel with two or more parts that define an electrolysis chamber with an outlet gap at the periphery thereof, along the surface of which wheel the tape to be treated is passed in operation to close the chamber, and which one or more parts that define the electrolysis chamber is axially displaceable.

7 Claims, 5 Drawing Figures

DEVICE FOR THE CONTINUOUS APPLICATION OF STRIP-, RIBBON- OR SPOT-SHAPED COATINGS

This invention relates to a device for the continuous application of strip-, ribbon- or spot-shaped coatings of metal layer patterns, particularly of noble metal on an electrically conductive tape, comprising a bipartite wheel adapted to rotate in operation about a stationary shaft, along the outer circumference of which the tape to be treated is passed, whilst the facing circumferential rims of the wheel parts constitute an output gap of an electrolyte chamber located in the interior of the wheel.

The coating material, usually a noble metal such as gold, is expensive so that the width of the coating, which is determined by the width of the output gap formed between the wheel parts, is preferably chosen so as not to exceed the absolutely required size. With regard thereto it is desirable to render the width of the output gap adjustable so that this width can be adapted to the products to be made and the invention has for its purpose to provide a device of the kind set forth in which the size of the output gap can be changed readily so that the setting of the device for matching the product to be manufactured requires little time, whilst in addition a more accurate adaptation of the width of the output gap can be attained.

According to the invention this can be achieved by rendering at least one of the wheel parts as a whole displaceable in an axial direction to be fixed in a plurality of positions relative to the shaft.

It is preferred for this purpose to arrange the adjustable wheel part with the aid of screwthread on a sleeve adapted to rotate about the shaft and fixed in an axial direction relative to the shaft. For adjusting the width of the gap it is then only necessary to turn the adjustable wheel part with respect to the sleeve, whilst particularly if a screwthread of fine pitch is chosen, a ready and yet particularly accurate adjustment of the gap can be ensured.

The invention will now be described more fully with reference to an embodiment of a device in accordance with the invention shown in the accompanying Figures.

FIG. 1 is a schematic side elevational view of a device by means of which coatings can be applied to an electrically conductive tape, for example, a metal strip or the like.

Figure 1:
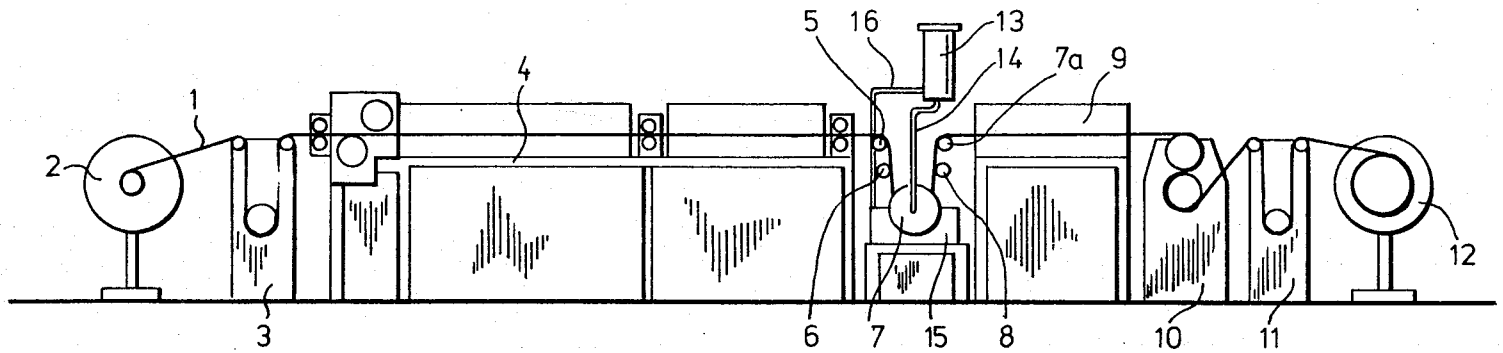

The complete device for applying coatings to an electrically conductive tape, for example, a metal tape 1, shown schematically in FIG. 1, comprises a reel 2, from which the tape to be treated 1 is wound.

From the reel 2 the tape is first passed across a stretching member 3, subsequently across a pretreatment device 4, and then guided along two superjacent guide rollers 5 and 6 downwards towards a wheel 7.

The tape 1 is guided around the wheel 7 and subsequently upwardly along two guide rollers 7a and 8, corresponding with the guide rollers 5 and 6 and through an aftertreatment section 9. Behind the aftertreatment section 9 the tape 1 is passed through a driving unit 10 and a further adjustable stretching unit 11, from which the tape is fed to a reel 12 for winding up the tape. To the interior of the wheel 7 is fed an electrolyte from a supply vessel 13 through a duct 14 including a cock (not shown) for regulating the quantity to be supplied per unit time.

From the interior of the wheel 7 the electrolyte, as will be apparent from the following description of the wheel 7, can flow into a tray 15, whilst with the aid of a pump (not shown) the electrolyte can be pumped back from the tray 15 through a duct 16 to the supply vessel 13.

Figure 2:
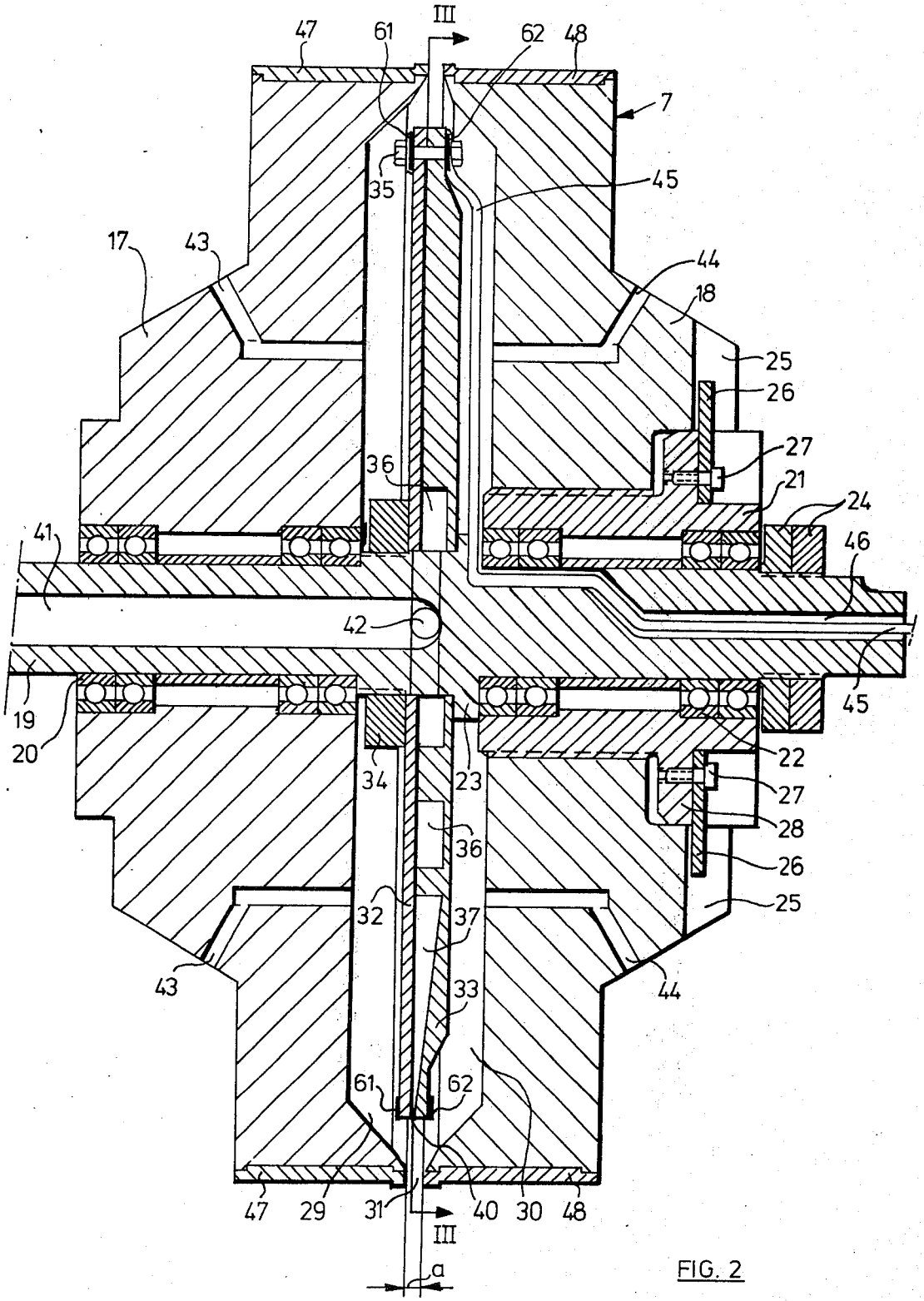
FIG. 2 is an enlarged sectional view of a wheel along which the tape to be coated is guided for the application of the coatings.

FIG. 2 shows that the wheel 7 has two wheel parts 17 and 18, arranged on a stationary shaft 19, arranged in a frame (not shown). The Figure shows that the wheel part 17 is rotatably journalled on the shaft with the aid of ball bearings 20, the wheel part 17 not being displaceable in an axial direction with respect to the shaft 19 because the bearings 20 holding the wheel part are enclosed between a thickened part of the shaft 19 located on the right-hand side of the wheel part and a frame portion (not shown) located on the left-hand side of the wheel part 17 (see FIG. 2) and supporting the shaft 19.

The wheel part 18 has a tapped bore receiving a sleeve 21 having outer screwthread. The sleeve 21 is rotatably journalled on the shaft 19 with the aid of ball bearings 22. The sleeve 21 cannot shift in an axial direction with respect to the shaft 19 because the ball bearings holding the sleeve are enclosed between a collar 23 integral with the shaft 19 and a safety nut 24 screwed onto the end of the shaft.

The end of the wheel part 18 remote from the wheel part 17 has a plurality of radial slots 25. At least two of these slots 25 receive the ends of safety plates 26, which are clamped tight with the aid of screw bolts 27 to a collar 28 integral with the sleeve 21. It will be obvious that the safety plates 26 prevent the wheel part 18 from turning with respect to the sleeve 21.

The facing sides of the two wheel parts 17 and 18 have recesses 29 and 30 respectively forming together a chamber communicating through an output gap 31 located between the wheel parts with the outer circumference of the wheel. The recesses 29 and 30 are shaped so that the diameter of each recess increases gradually towards the output gap 31.

Figure 3:
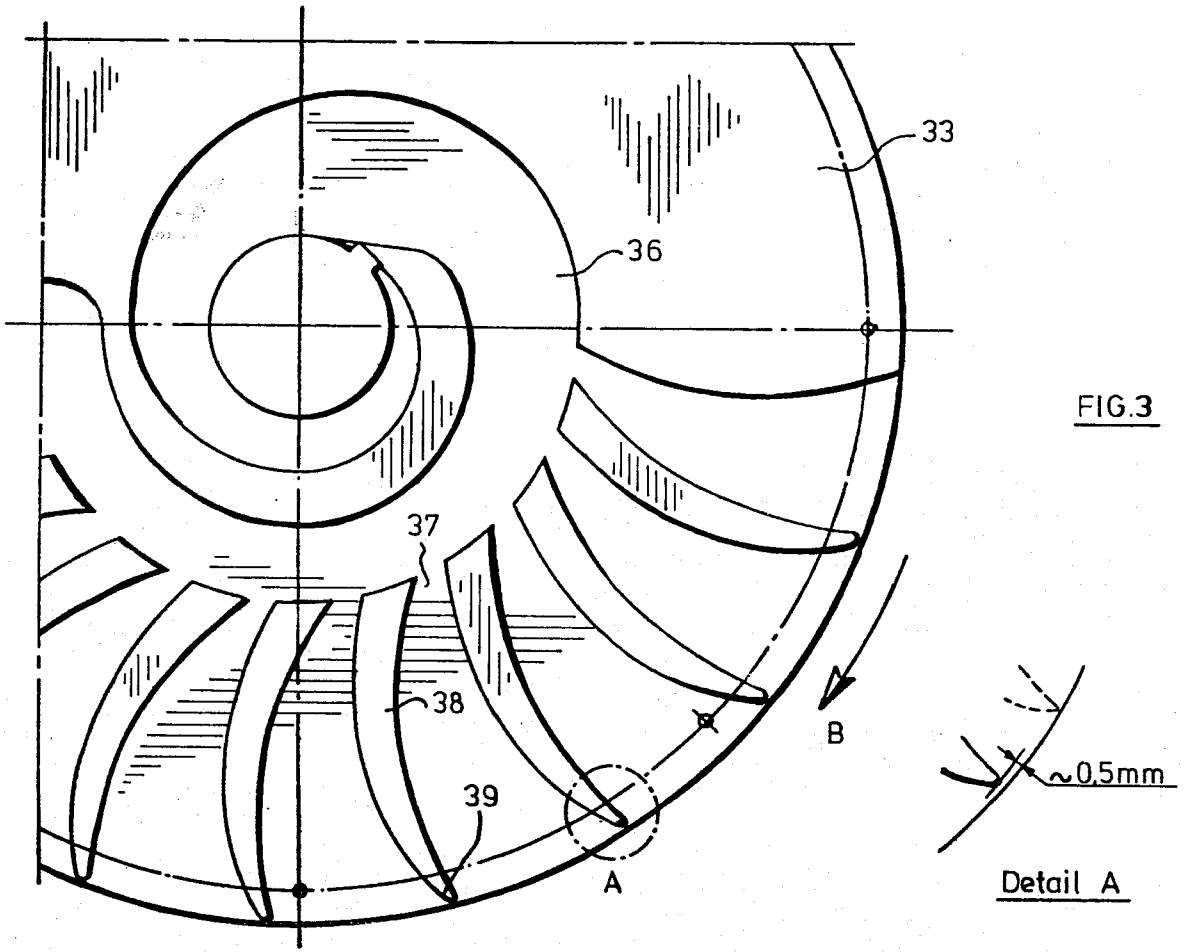
FIG. 3 is a sectional view taken on the line III—III in FIG. 2, the adjustable wheel part and the shaft being omitted.

The chamber formed by the recesses 29 and 30 accommodates two plates 32 and 33, which are clamped by means of a nut 34 screwed onto the shaft 19 to one another and to the collar 23 integral with the shaft 19. The plates 32 and 33 are preferably made of synthetic resin, for example, acrylate and provided with a left- and right-hand annular anode 61 and 62, which are fixed to the plates 32 and 33 by means of a plurality of bolts 35. The plates 32 and 33 may be glued to one another. The plate 32 is formed by a flat, cylindrical disc. The side of the plate 33 facing the plate 32 has a more or less spiral-shaped recess 36 around the centre line of the shaft 19, said recess having at least broadly the shape of a snail-shell. In the lower half of the plate said recess 36 communicates with channels 37 provided in the plate 33 and separated from one another by curved ridges 38, whose rounded-off ends 39 are spaced apart by a small distance from the outer circumference of the disc 33. The ridges 38 are curved so that their ends are slightly inclined opposite the direction of movement of the tape 1 in operation, indicated by the arrow B. Although FIG. 3 shows only a few ridges 38, it will be obvious that these ridges are uniformly distributed across the whole lower half of the plate 33.

From FIG. 2 it will furthermore be apparent that the width of the passages 37 gradually decreases from the recess 36 towards the outer circumference of the disc 33 so that at the lower half circumference of the plates only a narrow gap 40 is left between said two plates 32 and 33.

The shaft 19 has furthermore a bore 41 extending in the direction of length of the shaft 19, with which communicates the duct 14 in a manner not shown. Through four bores 42 relatively offset through 90° and extending at right angles to the centre line of the shaft 19 the bore 41 communicates with the recess 36 in the plate 33. The wheel parts 17 and 18 have furthermore channels 43 and 44 respectively, which connect the chamber formed by the recesses 29 and 30 with the outer circumferences of the wheel parts 17 and 18.

By means of one of the bolts 35 the end of a titanium wire 45 is secured to the anodes 61 and 62 and extends in the manner shown in FIG. 2 through a passage 46 in the shaft 19 to beyond the shaft 19.

The outer circumferences of the wheel parts 17 and 18 are surrounded by closing strips 47 and 48 respectively of slightly elastic material. In order to anchor these closing strips the wheel parts have recesses as shown in FIG. 2. The portion of such a closing strip bounding the output gap 31 is shown on an enlaraged scale in FIG. 5. From this Figure it will be apparent that the portion bounding the output gap is formed by a slightly raised rim 49, whose circumferential surface 50 has a slope such that the boundary edge of this circumferential surface having the larger diameter is also the boundary edge of the output gap 31. The angle $\alpha$ included by a generatrix of the plane 50 and a line parallel to the centre line of the shaft 19 is preferably about 30'. As will be seen from FIG. 5, the diameter of the boundary edge of the surface 50 remote from the output gap 31 is also larger than the outer diameter of the further part of the closing strip 48.

Figure 4:
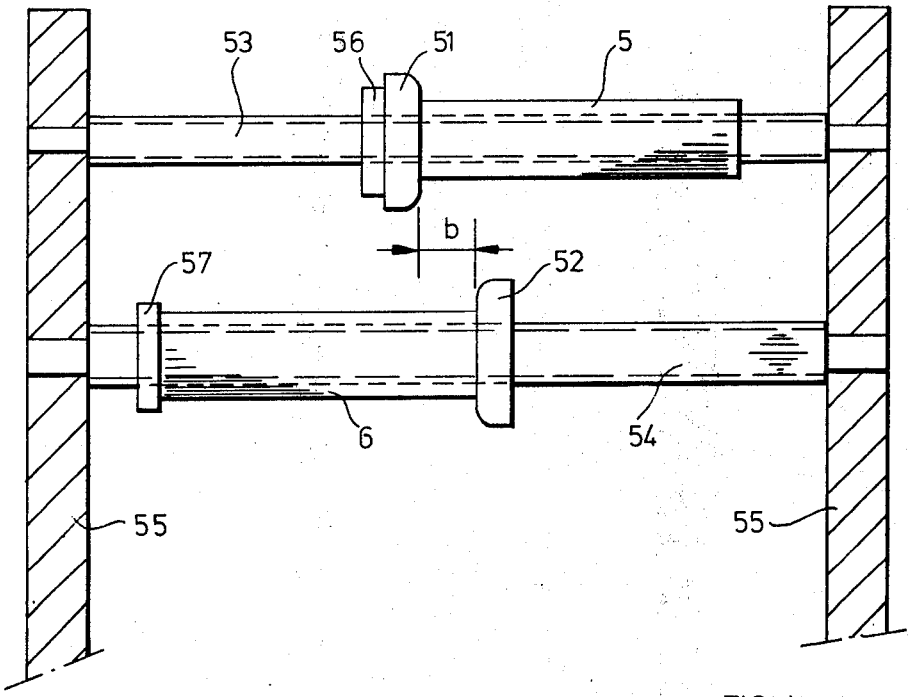
FIG. 4 shows schematically a disposition of guide rollers for the tape to be coated.

FIG. 4 shows a preferred disposition of the guide rollers 5 and 6. The guide rollers 7*a* and 8 are correspondingly constructed, so that further description thereof may be omitted.

FIG. 4 shows that the guide rollers 5 and 6 are formed by internally screwthreaded sleeves having each at one end a collar 51 and 52 respectively. The sleeves 5 and 6 are screwed onto externally screwthreaded shafts 53 and 54 respectively, which are freely rotatable in frame plates 55.

By turning them about the shafts 53 and 54 the guide rollers 5 and 6 can be adjusted so that the distance *b* between the proximal sides of the collars 51 and 52 is equal to the width of the tape to be treated. It may, in addition, be ensured that the positions of the collars 51 and 52 relative to the wheel 7 are such that by means of the guide rollers 5 and 6 the tape is guided so that the face of the tape to be treated is located just opposite the output gap 31 on the wheel. It will be apparent that by setting the guide rollers 5 and 6 and of the corresponding rollers 7*a* and 8 a more accurate guiding of the tape can be obtained in a simple manner, whilst if desired the coating may also be applied to the centre of the tape. In the position shown the rollers 5 and 6 are fixed in place by means of nuts 56 and 57 screwed onto the shafts 53 and 54 and adapted to be clamped in the manner shown in FIG. 4 against the ends of the sleeves.

The device depicted above operates as follows. The tape 1 to be treated is passed in the manner shown in FIG. 1 through the device and around the wheel 7 and drawn continuously across the device. By a correct adjustment of the guide rollers 5 to 8 it is ensured that the tape portion to be coated is accurately opposite the output gap 31. After removal of the safety plates 26 the width *a* of the gap 31 can be readily adjusted to the correct value by turning the wheel part 18 with respect to the sleeve 21. After the adjustment of the correct width *a* of the gap 31 the wheel part is again fixed in place by means of the safety plates 26 with respect to the sleeve 21. Since the wheel part 17 is invariably in a fixed position in the device, this wheel part may readily serve as a reference surface for the correct adjustment of the gap width *a* and for the correct adjustment of the guide rollers 5 to 8 with respect to the wheel 7.

In operation electrolyte is fed from the supply vessel 13 through the duct 14, the bore 41 and the bores 42 to the recess 36 in the disc 33 and this electrolyte flows through the outlet channels 37 between the ridges along the lower half circumference of the plates 32 and 33 through the gap 40. This electrolyte strikes along that part of the tape 1 to be treated which closes the gap 31. The excess quantity of electrolyte will flow through the passages 43 and 44 from the chamber formed by the recesses 29 and 30 into the tray 15, from which it is pumped back to the supply vessel 13. By regulating the feeding speed of the electrolyte, for example, by means of a closing member included in the duct 14, the level of the electrolyte in the chamber formed by the recesses 29 and 30 can be controlled.

Owing to the shape of the recess 36 described above and illustrated in FIG. 3 a uniform distribution of the electrolyte to the various channels 37 is ensured, whilst the shape of the ridges 38 terminating at a given distance from the outer circumference of the disc 33 ensure a uniform feed of electrolyte to the portion of the tape 1 covering the gap 31 without stagnant areas in the outgoing stream which is conductive to the speed of deposition of the material on the tape. The tape is operating as a cathode, whereas the plates 32 and 33 coupled with the titanium wire 45 operate as anodes.

The thickness of the coating galvanically applied in the manner described depends upon the speed of travel of the tape 1, the concentration of the electrolyte and the intensity of the current supplied by the power source to which the titanium wire 45 and the tape 1 are connected.

Figure 5:
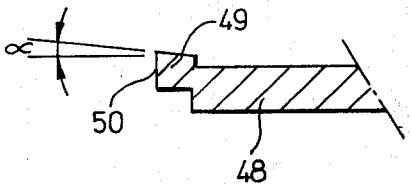
FIG. 5 shows on an enlarged scale part of a closing tape of slightly flexible material arranged around the outer circumference of a wheel part.

A leakage of electrolyte along the face of the tape 1 facing the wheel 7 is avoided by the tight contact between the tape 1 and the projecting parts 49 of the closing strips 47 and 48. Also owing to the slope of the circumferential face 50 of the projecting part 49 a very satisfactory seal is obtained along a sharply defined edge so that an accurate delimitation of the surface to be covered is obtained, which prevents logs of material to be deposited. A further advantage of the form of the closing strip shown in FIG. 5 is that an uneven outer edge of the tape can be compensated for without any difficulty because these outer edges will in practice no longer come into contact with the closing strips. When such closing strips 47 and 48 are employed, it is furthermore possible to employ without any difficulty tape material having, for example, bent-over edges, in which case recesses for the bent-over parts may, if necessary, be provided in the strips 47 and 48. After a given amount of wear said closing strips 47 and 48 can be readily replaced at low cost.

If it is desired to provide an undulated shape for the coating to be applied to the tape, this can be achieved by reciprocating in common the guide rollers 5 and 6 and the corresponding guide rollers 7*a* and 8 in a direction transverse of the direction of length of the tape. This may be carried out by moving to and fro the frame portion 55 supporting the guide rollers in a direction parallel to the centre lines of the shafts 53 and 54 or by simultaneously turning the guide rollers 5 and 6 along the shafts 53. If it is ensured that in operation the guide rollers 5 and 6 can, in addition turn independently of one another, it is possible to continuously treat tapes of varying width.

The embodiment shown in FIG. 5 is, without the need for further steps, particularly suitable for compensating for the so-called sword curve of tape material. This undulation phenomenon at the edge of tape material always occurs, in principal, and has a disturbing effect when it assumes certain proportions, but this is eliminated by the construction shown without further problems.

I claim:

1. A device for the continuous application of strip-, ribbon- or spot-like coatings of metal layer patterns to an electrically conductive tape comprising:

a. a shaft;

b. a plating wheel apparatus mounted with said shaft and having first and second members defining an output gap therebetween about the circumference of said wheel with the tape to be placed located opposite said output gap, said plating wheel forming an electrolyte chamber therein communicating with said output gap;

c. a sleeve mounted with said shaft and fixed with said shaft against axial movement relative to said shaft;

d. said second member having a screwthread arranged for engagement with said sleeve and being axially displaceable relative to said shaft for adjusting the width of said gap while the tape is located opposite said output gap;

e. said sleeve having a screwthread formed thereon engaging said screwthread of said second member to form a screwthread joint wherein relative rotation between said second member and said sleeve moves said second member in an axial direction along said shaft; and f. means with said plating wheel for releasably fixing said second member relative to said shaft to maintain the correct adjustment of said gap.

2. In a device as recited in claim 1, including means for guiding the conductive tape on and off the plating wheel and fixing a definite area of the tape to be coated relative to said gap, which comprises:

a. a first roller means for guiding the tape to the plating wheel comprising first and second guide rollers formed by an internally screwthreaded sleeve having a collar formed thereon threaded, said first and second guide rollers being threaded on externally threaded surfaces on the first and second shafts, respectively, with each of the first and second shafts journaled for rotation, and with axes of the shafts substantially parallel to the axis of the plating wheel, with said first and second shafts spaced to maintain said collar from engagement, and with the guide rollers adjustable on said shafts, with the distance between the collars slightly more than the width of the conductive tape; and b. a second roller means for guiding the tape off the plating wheel comprising third and fourth guide rollers formed by an internally screwthreaded sleeve having a collar formed thereon threaded, said first and second guide rollers being threaded on externally threaded surfaces on the third and fourth shafts, respectively, with each of the first and second shafts journaled for rotation, and with axes of the third and fourth shafts substantially parallel to the axis of the plating wheel, with said first and second shafts spaced to maintain said collar from engagement and with the guide rollers adjustable on said shafts, with the distance between the collars slightly more than the width of the conductive tape.

3. A device as recited in claim 2, in which each of internally screwthreaded rollers is axially displaceable along its shaft and is provided with means for moving the internally screwthreaded rollers with respect to the axes of the shafts on which they are threaded to provide an undulating shape for the coating to be applied to the tape.

4. A device as recited in claim 1, wherein said means for releasably fixing includes:

said second member forming a surface having a recess; and a safety member releasably fixed with said shaft and arranged to be received within said recess when said safety member is fixed with said shaft, said safety member being released from said shaft to enable movement from said recess for adjusting the width of the gap.

5. A device as recited in claim 1, wherein said means for releasably fixing further includes:

said second member forming a surface having a recess; and a safety member releasably secured with said sleeve and arranged to be received within said recess when said safety member is fixed with said sleeve, said safety members being released from said shaft to enable movement from said recess for adjusting the width of the gap.

6. A device as recited in claim 1, wherein the first member defining the output gap is fixed in place relative to the shaft.

7. In a device for the continuous application of strip-, ribbon- or spot-like coatings of metal layer patterns to an electrically conductive tape, comprising a plating wheel adapted to rotate about a stationary shaft, the tape to be treated is passed in operation along the outer circumference of said wheel, whilst the facing circumferential edges of the wheel parts define an output gap of an electrolyte chamber located in the interior of the wheel, the improvement which comprises:

having at least one of the wheel parts that form a boundary of the chamber is axially displaceable and fixable in a plurality of positions relative to the shaft with the tape in place, so that the output gap can be adjusted without having to remove the tape from contact with the plating wheel;

said axially displaceable chamber boundering part supported by a screwthread joint on a sleeve rotatable about the stationary shaft;

the output gap being adjusted by rotating the axially displaceable chamber boundering part about the screwthread sleeve;

said axially displaceable chamber boundering part provided with one or more radial recesses, in at least one part of which a safety plate is located fixed in position relative to the shaft; and said screwthreaded sleeve on which the axially displaceable chamber boundering part is arranged to turn, is provided on the side remote from the electrolyte chamber with a collar to which the safety plate is secured to a slot in the axially displaceable chamber boundering part with the edge of a bolt.

* * * * *